US010359264B2

(12) United States Patent
Teowee et al.

(10) Patent No.: US 10,359,264 B2
(45) Date of Patent: Jul. 23, 2019

(54) ELECTRONIC DETONATOR, ELECTRONIC IGNITION MODULE (EIM) AND FIRING CIRCUIT FOR ENHANCED BLASTING SAFETY

(71) Applicant: Austin Star Detonator Company, Cleveland, OH (US)

(72) Inventors: Gimtong Teowee, Westlake Village, CA (US); James D. Heckelman, Norwalk, OH (US)

(73) Assignee: Austin Star Detonator Company, Cleveland, OH (US)

( * ) Notice: Subject to any disclaimer, the term of this patent is extended or adjusted under 35 U.S.C. 154(b) by 0 days.

(21) Appl. No.: 15/661,518

(22) Filed: Jul. 27, 2017

(65) Prior Publication Data

US 2018/0045498 A1 Feb. 15, 2018

Related U.S. Application Data

(60) Provisional application No. 62/373,715, filed on Aug. 11, 2016.

(51) Int. Cl.

| | |
|---|---|
| ***F42C 11/06*** | (2006.01) |
| ***F42D 1/055*** | (2006.01) |
| *F42C 19/08* | (2006.01) |

(52) U.S. Cl.

CPC ..... *F42C 11/06* (2013.01); *F42D 1/055* (2013.01); *F42C 19/08* (2013.01)

(58) Field of Classification Search

USPC ..... 102/206, 202.9, 201.1

See application file for complete search history.

(56) References Cited

U.S. PATENT DOCUMENTS

| | | | | |
|---|---|---|---|---|
| 4,393,779 | A | 7/1983 | Brede et al. | |
| 4,699,241 | A * | 10/1987 | Kerekes | G01V 1/13 102/217 |
| 5,309,841 | A | 5/1994 | Hartman et al. | |
| 6,085,659 | A | 7/2000 | Beukes et al. | |
| 6,173,651 | B1 | 1/2001 | Pathe et al. | |
| 6,789,483 | B1 | 9/2004 | Jennings, III et al. | |
| 6,892,643 | B2 | 5/2005 | Jennings, III | |
| 6,966,262 | B2 | 11/2005 | Jennings, III | |

(Continued)

FOREIGN PATENT DOCUMENTS

| | | |
|---|---|---|
| EP | 2 352 964 B1 | 8/2011 |
| WO | WO 2011/014891 | 2/2011 |
| WO | WO 2016/037196 A1 | 3/2016 |

OTHER PUBLICATIONS

International Search Report and Written Opinion for PCT/US2017/044184 dated Oct. 6, 2017.

(Continued)

*Primary Examiner* — Reginald S Tillman, Jr.
(74) *Attorney, Agent, or Firm* — Fay Sharpe LLP

(57) ABSTRACT

Disclosed examples include firing control electronic circuits, such as electronic ignition modules (EIMs), electronic detonators and firing circuits for blasting applications, in which a Zener diode or one or more general purpose diodes is connected between a firing capacitor and charging voltage source in a circuit with a detonator ignition element to block voltage below a certain desired level so that the firing capacitor is not charged to enhance safety in the logger mode.

18 Claims, 2 Drawing Sheets

(56) References Cited

U.S. PATENT DOCUMENTS

| | | | |
|---|---|---|---|
| 6,988,449 | B2 | 1/2006 | Teowee et al. |
| 7,017,494 | B2 | 3/2006 | Kouznetsov |
| 7,054,131 | B1 | 5/2006 | Kanth et al. |
| 7,082,877 | B2 | 8/2006 | Jennings, III |
| 7,086,334 | B2 | 8/2006 | Jennings, III |
| 7,107,908 | B2 | 9/2006 | Forman et al. |
| 7,301,750 | B2 | 11/2007 | DeVries et al. |
| 7,322,293 | B2 | 1/2008 | Kouznetsov |
| 7,347,145 | B2 | 3/2008 | Teowee et al. |
| 7,464,647 | B2 | 12/2008 | Teowee et al. |
| 7,533,613 | B2 | 5/2009 | Kouznetsov |
| 7,577,756 | B2 | 8/2009 | Teowee et al. |
| 7,617,775 | B2 | 11/2009 | Teowee |
| 7,681,500 | B2 | 3/2010 | Teowee |
| 7,870,825 | B2 | 1/2011 | Teowee |
| 7,971,531 | B2 | 7/2011 | Teowee et al. |
| 7,975,612 | B2 | 7/2011 | Teowee et al. |
| 8,176,848 | B2 | 5/2012 | Teowee et al. |
| 9,243,877 | B2 * | 1/2016 | Hayes ..... F42B 3/18 |
| 2003/0221575 | A1 | 12/2003 | Walsh et al. |
| 2003/0221576 | A1 | 12/2003 | Forman et al. |
| 2008/0223241 | A1 | 9/2008 | Hurley |
| 2010/0000435 | A1 | 1/2010 | Trousselle et al. |
| 2011/0247517 | A1 | 10/2011 | Hurley et al. |
| 2013/0075747 | A1 | 3/2013 | Purtell |

OTHER PUBLICATIONS

Electronic Initiation System, "The SDI Electronic Initiation System", Special Devices, Inc., EIM Brochure, www.specialdevices.com/docs/EIM_Brocure.pdf, 4 pages.

* cited by examiner

ELECTRONIC DETONATOR, ELECTRONIC IGNITION MODULE (EIM) AND FIRING CIRCUIT FOR ENHANCED BLASTING SAFETY

REFERENCE TO RELATED APPLICATION

The present application claims priority to and the benefit of U.S. Provisional Patent Application No. 62/373,715, filed Aug. 11, 2016 and entitled ELECTRONIC DETONATOR WITH ENHANCED SAFETY AT LOGGER LEVEL, the entirety of which is hereby incorporated by reference.

BACKGROUND AND INCORPORATION BY REFERENCE

Blasting is used in the recovery of mineral resources, including in surface mining and quarrying for rock fragmentation and displacement of the broken rock. In blasting operations, detonators and explosives are buried in the ground, for example, in holes (e.g., bore holes) drilled into rock formations, etc., and the detonators are wired for external access to blasting machines that provide electrical signaling to initiate detonation of explosives. Electronic detonators have been developed which implement programmable delay times such that an array of detonators can be actuated in a controlled sequence. Electronic detonators are programmed using a logger, and later actuated or ignited using a blasting machine. The logger and the blasting machine to provide different voltages to a connected detonator in order to guard against inadvertent ignition during logging or programming operations. The electronic detonator typically includes a storage capacitor to store power to operate the internal detonator circuitry for reading and writing operations during programming by a logger. In addition, the detonator includes a firing capacitor that can be charged while the detonator is connected to a blasting machine, in order to selectively provide energy to an ignition element in response to a firing signal from the blasting machine. Ideally, the firing capacitor is not charged by a connected logger, but instead is charged only once a higher voltage blasting machine is connected to the detonator. In particular, each detonator in an electronic detonator blasting system may be queried electrically by a logger or programming unit, which contains voltage and current power sources. Such power sources should be insufficient to cause firing in the logger mode, or contain enough number of failure modes resulting in low likelihood of firing the electronic detonator during the logging or programming phase in the field. Optical means (e.g., bar code scanners, etc.) can instead be used for logging without any electrical signal exchange between the logger and electronic detonator, but it is more efficient to make electrical contact to also confirm that electrical communication exists and is reliable. Notably if there is a cut legwire, or a faulty electronic circuit inside the electronic detonator, such electrical contact, communication and/or diagnostics can alert the blaster of any potential issues, which would not otherwise be revealed using only optical logging. Further developments would therefore be beneficial to alleviate the probability of inadvertent firing during electrical communications to enhance the level of safety for electronic detonators connected to loggers over the boreholes containing explosives. The following documents are incorporated by reference in their entireties: U.S. Pat. Nos. 9,243,877; 5,309,841; 7,301,750; 4,393,779; European patents EP 1831636 and EP 2 352 964 and Published International Application WO 2011/014891.

SUMMARY

Various aspects of the present disclosure are now summarized to facilitate a basic understanding of the disclosure, wherein this summary is not an extensive overview of the disclosure, and is intended neither to identify certain elements of the disclosure, nor to delineate the scope thereof. Instead, the primary purpose of this summary is to present some concepts of the disclosure in a simplified form prior to the more detailed description that is presented hereinafter. Disclosed examples include firing control electronic circuits, such as electronic ignition modules (EIMs), electronic detonators and firing circuits for blasting applications, in which one or more diodes is/are is coupled between a firing capacitor and charging voltage source in a circuit with a detonator ignition element to block voltage below a certain desired level so that the firing capacitor is not charged to enhance safety in the logger mode.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
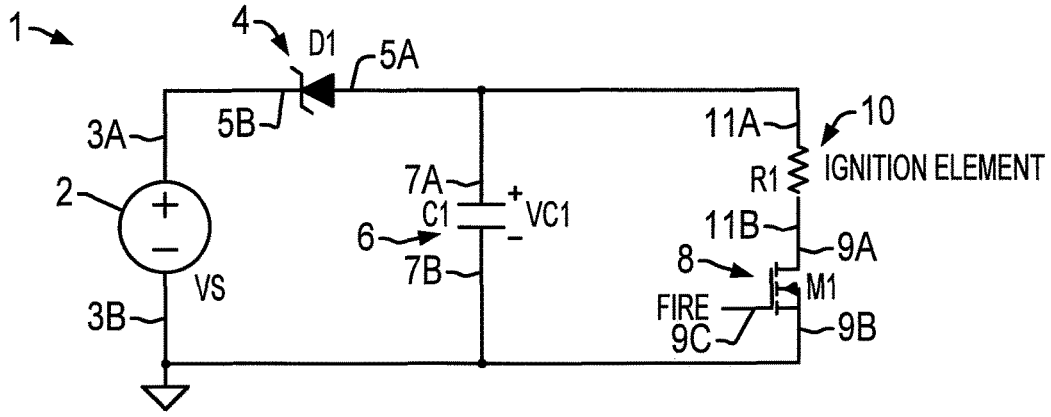
FIG. 1 is a schematic diagram illustrating an example firing circuit for an electronic detonator including a Zener diode disposed between a charging voltage source and a firing capacitor.

Referring now to the figures, several embodiments or implementations of the present disclosure are hereinafter described in conjunction with the drawings, wherein like reference numerals are used to refer to like elements throughout, and wherein the various features and plots are not necessarily drawn to scale. The terms "couple" or "couples" or "coupled" are intended to include indirect or direct electrical or mechanical connection or combinations thereof. For example, if a first device couples to or is coupled with a second device, that connection may be through a direct electrical connection, or through an indirect electrical connection via one or more intervening devices and connections.

Figure 3:
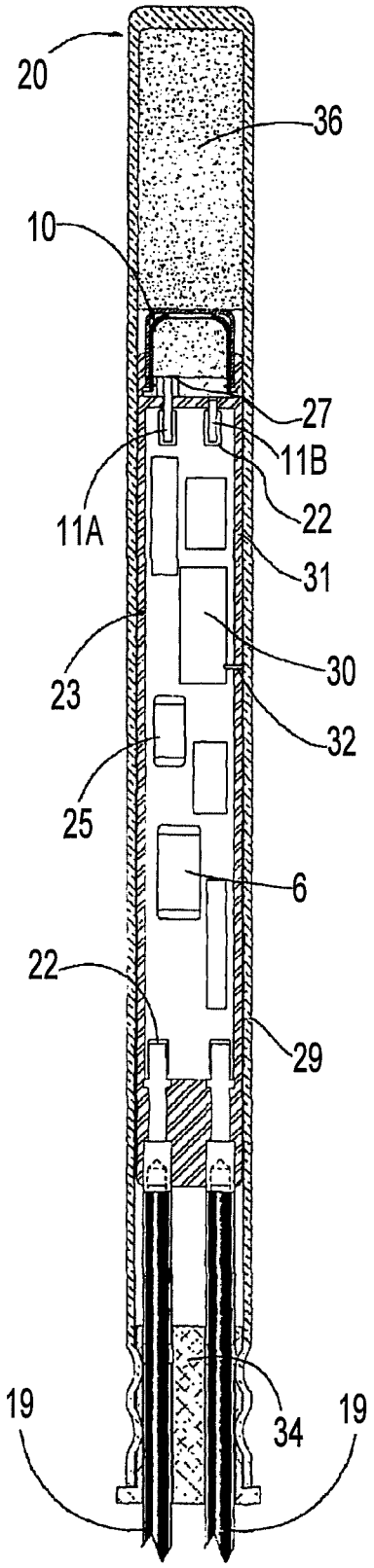
FIG. 3 is a sectional view of an electronic detonator including an electronic ignition module (EIM) with the firing circuit of FIG. 1.

Referring initially to FIGS. 1 and 3, disclosed examples include firing control electronic circuits, referred to herein as electronic ignition modules EIMs 23, electronic detonators 20 and firing circuits 1 for blasting applications, in which a Zener diode 4 (D1 in FIG. 1) is coupled between a firing capacitor 6 and charging voltage source 2 in a circuit with a detonator ignition element 10 to block voltage below a certain desired level so that the firing capacitor 6 is not charged to enhance safety. In other implementations, a general diode can be coupled between the firing capacitor 6 and the charging voltage source 2. The polarity is reversed for a normal diode (e.g., anode to charging source) than for a Zener diode 4 (e.g., anode to ignition element as shown in FIG. 1). In other examples, multiple diodes can be coupled between the firing capacitor 6 and the charging voltage source 2, including general diodes, Zener diodes or combinations thereof. The EIM 23 in one example includes a fusehead or bridgewire or other suitable ignition element 10 (shown as R1 in FIG. 1), for example, compliant with appropriate Bruceton all-fire and no-fire specifications. The Zener diode 4 is connected in series with one or more firing capacitors 6 (C1), herein referred to as a firing capacitor C1 whether a single capacitor component or multiple capacitors connected in series and/or parallel with one another or combinations thereof.

The EIM 23 in certain embodiments includes a tantalum capacitor 6, although other capacitor types can be used such as electrolytic, ceramic, etc., in series with the Zener diode 4. The improved EIM examples 23 can advantageously employ small surface mount tantalum capacitors 6 instead of larger radial aluminum electrolytic capacitors to facilitate circuit board manufacturing and final assembly of an electronic detonator assembly 20 (FIG. 3). Moreover, the novel Zener-based firing circuit 1 enhances blasting site safety and reliability by fully or at least partially blocking the firing capacitor 6 from voltage of a connected logger (not shown). For example, certain implementations use a low leakage 8.2 V Zener diode 4 connected in series with the firing capacitor 6 to block any voltage beyond 8.2 V, therefore practically cutting off a typical logger bus voltage of 7.5 V from ever reaching the firing capacitor 6 and bridgewire network 10. Moreover, the series connected Zener 4 attenuates the voltage imposed on the firing capacitor 6, thereby allowing the use of compact, lower voltage tantalum (Ta) capacitor(s) 6 with an acceptable voltage rating, where tantalum capacitors 6 provide better reliability and performance during firing discharge compared with larger electrolytic types.

Certain disclosed examples may employ a low leakage Zener 4 to advantageously obtain a sharper more controlled blocking Zener knee voltage. In operation in a blasting application, individual detonators 20 are queried electrically by a logger or programming unit (not shown), which includes voltage and current power sources. Such power sources are ideally insufficient to cause firing in the logger mode.

FIG. 1 shows a firing circuit example 1 in which the Zener 4 is connected between the charging voltage source 2 and the firing capacitor 6 but before the fusehead or ignition element 10, and FIG. 3 shows an electronic detonator 20 with an EIM 23 including the firing circuit 1 of FIG. 1. The firing circuit 1 includes the charging source 2 including first and second (e.g., positive and negative) charging source terminals 3A and 3B, where the charging source 2 is configured in one example to selectively provide a charging voltage signal VS between the first and second charging source terminals 3A, 3B. In certain examples, the charging source 2 provides the charging voltage signal VS using power obtained from leg wires 19 from a connected blasting machine or logger device (FIG. 3). In certain examples, moreover, the charging source 2 is configured to selectively provide the charging voltage signal VS including a positive voltage at the first charging source terminal 3A relative to the second charging source terminal 3B. The firing circuit 1 includes an ignition element 10 with first and second electrical terminals 11A and 11B, respectively. As seen in FIG. 3, the ignition element 10 is operatively associated with a base charge 36 of the electronic detonator assembly 20 to selectively ignite the base charge 36 in response to conduction of electrical current through the ignition element 10.

The circuit 1 in FIG. 1 also includes the Zener diode D1 (4) with an anode 5A connected to the first electrical terminal 11A of the ignition element 10, and a cathode 5B connected to the first charging source terminal 3A of the charging source 2. The Zener diode 4 in one embodiment has a Zener voltage (Vz) of approximately 8.2 V for use with loggers that provide a voltage of about 7.5 V on the detonator leg wires 19 (FIG. 3). In certain examples, the Zener diode 4 is a low leakage Zener diode. The firing capacitor C1 (6) includes a first capacitor terminal 7A connected to the first electrical terminal 11A of the ignition element 10, and a second capacitor terminal 7B connected to the second charging source terminal 3B of the charging source 2. The firing capacitor 6 in certain examples includes at least one tantalum capacitor. The circuit 1 also includes a switching device 8 (e.g., MOSFET M1) connected between the second electrical terminal 11B of the ignition element 10 and the second charging source terminal 3B of the charging source 2. The switch 8 can be below or on top of the ignition element next to the firing capacitor 6. The switch 8 can be contained inside an ASIC or a separate component, e.g. MOSFET, BJT, MESFET, bipolar transistor, or other suitable electrical switch including a control terminal to receive a control signal FIRE to selectively connect the second electrical terminal 11B of the ignition element 10 to the second charging source terminal 3B of the charging source 2 to allow current to flow through the ignition element 10 ignite the base charge 36. The host EIM 23 in FIG. 3 includes a control circuit 30, such as an ASIC, to selectively provide the control signal FIRE to operate the switching device 8, and the control circuit 30 in certain examples is programmable to provide the control signal FIRE at the programmed delay time after the EIM 23 receives an input FIRE signal from a connected blasting machine (not shown) via leg wires 19 in FIG. 3.

FIG. 3 shows an electronic detonator 20, including a housing 29 with an interior, a base charge 36 disposed within the interior of the housing 29, where the ignition element 10 is operatively associated with the base charge 36 to selectively ignite the base charge 36 in response to conduction of electrical current through the ignition element 10. The detonator 20 also includes a pair of wires 19 (leg wires) coupled with the EIM 23 to allow delivery of an input signal from a connected blasting machine (not shown) to the electronic detonator 20. As shown in FIG. 3, the detonator 20 is an electronic detonator with a programmable delay time, including an EIM 23 implementing the firing circuit 1 of FIG. 1, a shell housing or enclosure 29, the base charge 36 (preferably comprising a primary charge and base charge), the leg wires 19, and an end plug 34 that may be crimped in the open end of the shell 29. The EIM 23 is preferably programmable and includes an ignition element or fusehead 10 and a circuit board with various electronic components implementing the EIM 23 and the firing circuit 1.

The ignition element 10 in one example is a hermetically sealed device that includes a glass-to-metal seal and a bridgewire 27 designed to reliably ignite a base charge contained within the ignition element 10 upon the passage through the bridgewire 27 of electricity via pins 11A and 11B at a predetermined "all-fire" voltage level. The ignition element 10 can also consist of a fusehead, for example. The EIM 23 (including its electronics and part or all of its ignition element 10) may be insert-molded into an encapsulation 31 to form a single assembly with terminals for attachment of the leg wires 19. U.S. patent application Publication 2003/0221575A1, published Dec. 4, 2003 and U.S. patent application Publication 2003/0221576A1, published Dec. 4, 2003, are hereby incorporated by reference for their applicable teachings of the construction of such detonators 20 beyond the description that is set forth herein. The EIM 23 can be manufactured and handled in standalone form, for later incorporation by a user into the user's own custom detonator assembly (including a shell 29 and base charge 36). The encapsulation 31 can be alternatively replaced by other packaging methods or materials such as heat shrink, epoxy or conformal coating.

The circuit board of the EIM 23 includes a control circuit, such as a microcontroller or programmable logic device or an application-specific integrated circuit chip (ASIC) 30 to selectively provide the FIRE control signal to operate the switch 8, as well as a filtering capacitor, a storage capacitor 25 to hold an electrical charge and power the EIM 23 when the detonator 20 is responding back to a master device (not shown), the firing capacitor 6 (e.g., 47 to 374 μF) to hold an energy reserve that is used to selectively fire the detonator 20 when the switch 8 is closed, additional electronic components, and contact pads 22 for connection to the leg wires 19 and the ignition element 10. A shell ground connector 32 protruding from the EIM 23 for contact with the shell 29 is connected to, e.g., a metal can pin on the circuit board within the EIM 23 (further connected to, e.g., an integrated silicon controlled resistor or a diode) that can provide protection against electrostatic discharge and radio frequency and electromagnetic radiation that could otherwise cause damage and/or malfunctioning. The ASIC 30 in one example is a mixed signal chip with inputs to the leg wires 19 and for connection to the shell 29, a connection to the firing capacitor 6 and bridgewire 27 of the ignition element 10.

The charging source 2 provides the supply voltage VS inside the electronic detonator 20, having voltage from 12 V to as high as 42 V in operation. The firing capacitor 6 stores the electrical charge in the armed state, ready to discharge into the ignition element 10 at the designated programmed delay time when the control circuit closes the switch 8. The ignition element (R1) is the active bridgewire which ignites upon sufficient energy from capacitive discharge from the firing capacitor 6. The switch 8 turns on according to the FIRE control signal from the control circuit (ASIC) 30 to allow the passage of electrical charge energy stored in the firing capacitor 6 at the appropriate delay time.

The Zener diode 4 (D1) is connected between the charging source VS and the firing capacitor C1. The cathode of the Zener diode is connected to the same node at the positive of the charging source, VS. The anode of the Zener diode 4 is connected to the same node as the firing capacitor C1. In this configuration, a voltage drop exists between charging source 2 and the firing capacitor 6, by which the ignition element 10 sees the diminished voltage from the firing capacitor. For example, using an 8.2 V Zener 6, the voltage difference is the value of the voltage drop across the Zener 4 thus alleviating the net voltage seen by the firing capacitor 6. For example, for charging source VS of 20 V, the voltage on the firing capacitor 6 is 20−8.2=11.8 V. Additionally if the bus voltage VS is 8.2 V or lower, there is no voltage at all on the firing capacitor 6. Therefore, if a logger operating at 7.5 V or 8 V is connected to the legwires 19, if a voltage is inadvertently developed on the charging source 2, the net voltage is still zero on the firing capacitor 6. Thus, the EIM 23 adds a further level of safety through the rejection of elevated voltage beyond a certain point, especially at typical logger operating voltage levels.

Figure 2:
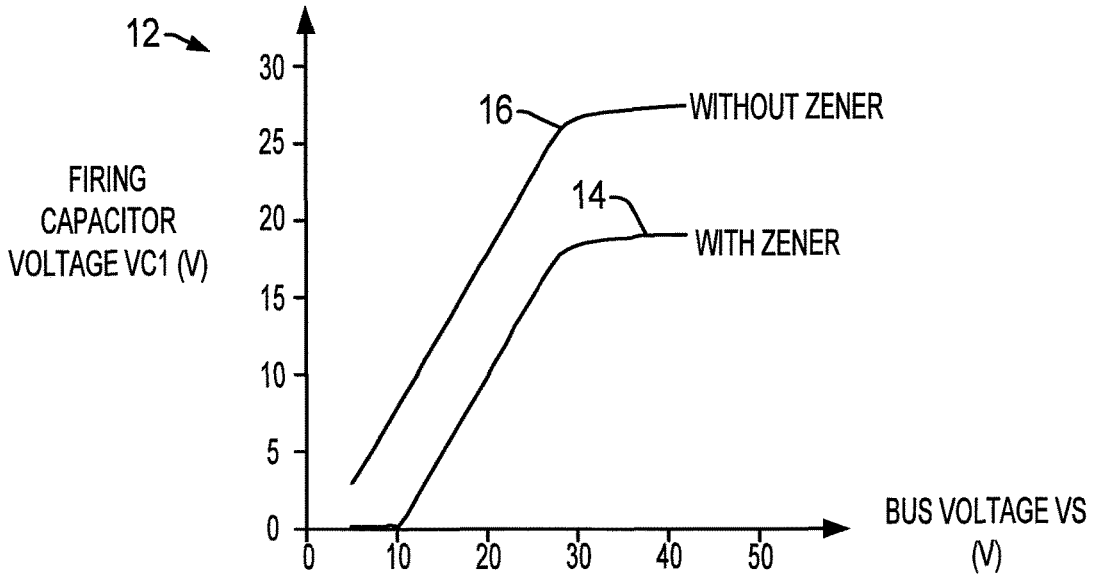
FIG. 2 is a graph of firing capacitor voltage as a function of charging source bus voltage.

FIG. 2 is a graph 12 showing Firing Cap Voltage vs. Bus Voltage curve 14 with the Zener diode 4 in the circuit 1, and a comparison curve 16 where no Zener 4 is used. There is a slope on the curve 14 of the effective voltage on the firing cap as a function of the input bus voltage VS, and the voltage on the capacitor both curves 14 and 16 start saturating at bus voltage above 28 V. In the example EIM 23 with the Zener diode 4, there is no voltage at all on the firing capacitor 6 at bus voltages of 11.0 V or below (curve 14), and the typical logger bus voltage is nominally 7.5 V. In one failure mode of ASIC breakdown and in an unlikely scenario of the firing capacitor 6 charging directly from bus logger voltage (curve 16), the Zener diode 4 keeps the voltage essentially at zero volts (curve 14).

There are a variety of possible variations such as different types or ranges of materials, dimensions, configurations, modifications, parts, options, etc. that might reasonably achieve roughly the same goals. Certain advantages are facilitated by the disclosed examples, including the ability to use tantalum capacitors 6 for easy assembly into EIM PCBs via pick and place of surface mount components 6 without requiring manual soldering or placement as with larger electrolytic capacitor types. Additionally, the tantalum capacitors 6 are more robust mechanically, whereas aluminum electrolytic capacitors are more prone to dynamic pressure crushing. The new disclosed examples alleviate potential misfires resulting from damaged firing capacitors. The use of the Zener diode 4 blocks voltage of a predetermined value (e.g., 8.2 V) from firing capacitor, and provides a safer detonator 20 at logger mode in case of bus voltage inadvertently applied across firing capacitor 6, and allows the use of smaller and lower voltage rated capacitors, thereby saving space and cost. Moreover, if the Zener were instead placed between the firing capacitor 6 and the fusehead/ignition element 10, it would need to be high wattage to conduct the high current safely, and due to finite resistance in the Zener, there will be lost power and energy across this Zener in delivering the energy to the ignition element. In contrast, in the disclosed example, when then Zener 4 is placed before the firing capacitor 6 there is a direct path form the firing capacitor 6 to the ignition element 10 thus ensuring more efficient energy transfer from the firing capacitor 6 to the ignition element 10.

The example embodiments have been described with reference to the preferred embodiments. Modifications and alterations will occur to others upon reading and understanding the preceding detailed description. It is intended that the exemplary embodiment be construed as including all such modifications and alterations insofar as they come within the scope of the appended claims or the equivalents thereof. The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software and/or firmware, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

The following is claimed:

1. An electronic detonator, comprising:

a housing with an interior;

a base charge disposed within the interior of the housing;

an ignition element, including first and second electrical terminals, the ignition element operatively associated with the base charge to selectively ignite the base charge in response to conduction of electrical current through the ignition element; and a firing control electronic circuit, including:

a firing circuit, including:

a charging source including first and second charging source terminals, the charging source configured to selectively provide a charging voltage signal between the first and second charging source terminals, a Zener diode, including an anode coupled with the first electrical terminal of the ignition element, and a cathode coupled with the first charging source terminal of the charging source, a firing capacitor including a first capacitor terminal directly connected to the first electrical terminal of the ignition element, and a second capacitor terminal directly connected to the second charging source terminal of the charging source, and a switching device connected between the second electrical terminal of the ignition element and the second charging source terminal of the charging source, the switching device including a control terminal to receive a control signal to selectively connect the second electrical terminal of the ignition element to the second charging source terminal of the charging source to allow current to flow through the ignition element to ignite the base charge; and a pair of wires coupled with the firing control electronic circuit to allow delivery of an input signal from a connected logger or blasting machine to the electronic detonator.

2. The electronic detonator of claim 1, wherein the firing control electronic circuit includes a control circuit to selectively provide the control signal to operate the switching device.

3. The electronic detonator of claim 2, wherein the control circuit is programmable to provide the control signal a programmed delay time after the firing control electronic circuit receives the input signal.

4. The electronic detonator of claim 1, wherein the firing capacitor includes at least one tantalum capacitor or electrolytic capacitor or ceramic capacitor.

5. The electronic detonator of claim 1, wherein the charging source provides the charging voltage signal using power obtained from the pair of wires from a connected blasting machine.

6. The electronic detonator of claim 5, wherein the charging source is configured to selectively provide the charging voltage signal including a positive voltage at the first charging source terminal relative to the second charging source terminal.

7. The electronic detonator of claim 1, wherein the charging source is configured to selectively provide the charging voltage signal including a positive voltage at the first charging source terminal relative to the second charging source terminal.

8. The electronic detonator of claim 1, wherein the diode is a Zener diode has a Zener voltage of approximately 8.2 V.

9. A firing control electronic circuit with a firing circuit for igniting a detonator, comprising:

a charging source including first and second charging source terminals, the charging source configured to selectively provide a charging voltage signal between the first and second charging source terminals;

a Zener diode, including an anode coupled with a first electrical terminal of an ignition element, and a cathode coupled with the first charging source terminal of the charging source a firing capacitor including a first capacitor terminal directly connected to a first electrical terminal of an ignition element, and a second capacitor terminal directly connected to the second charging source terminal of the charging source; and a switching device connected between a second electrical terminal of the ignition element and the second charging source terminal of the charging source, the switching device including a control terminal to receive a control signal to selectively allow current to flow through the ignition element between the second electrical terminal of the ignition element and the second charging source terminal of the charging source.

10. The firing control electronic circuit of claim 9, further comprising a control circuit to selectively provide the control signal to operate the switching device.

11. The firing control electronic circuit of claim 10, wherein the control circuit is programmable to provide the control signal a programmed delay time after an electronic ignition module receives an input signal from a connected blasting machine.

12. The firing control electronic circuit of claim 10, wherein the firing capacitor includes at least one tantalum capacitor or electrolytic capacitor or ceramic capacitor.

13. The firing control electronic circuit of claim 10, wherein the charging source is configured to selectively provide the charging voltage signal including a positive voltage at the first charging source terminal relative to the second charging source terminal.

14. The firing control electronic circuit of claim 9, wherein the firing capacitor includes at least one tantalum capacitor or electrolytic capacitor or ceramic capacitor.

15. The firing control electronic circuit of claim 9, wherein the charging source is configured to selectively provide the charging voltage signal including a positive voltage at the first charging source terminal relative to the second charging source terminal.

16. The firing control electronic circuit of claim 9, wherein the Zener diode has a Zener voltage of approximately 8.2 V.

17. A firing circuit for a blasting detonator, including:

a charging source including first and second charging source terminals, the charging source configured to selectively provide a charging voltage signal including a positive voltage at the first charging source terminal relative to the second charging source terminal;

a Zener diode, including an anode coupled with a first electrical terminal of an ignition element, and a cathode coupled with the first charging source terminal of the charging source;

a firing capacitor including a first capacitor terminal directly connected to the first electrical terminal of the ignition element, and a second capacitor terminal directly connected to the second charging source terminal of the charging source;

a switching device connected between a second electrical terminal of the ignition element and the second charging source terminal of the charging source, the switching device including a control terminal to receive a control signal to selectively connect the second electrical terminal of the ignition element to the second charging source terminal of the charging source to allow current to flow through an ignition element; and an ignition element, including first and second electrical terminals, the ignition element operative to selectively ignite an associated base charge in response to conduction of electrical current through the ignition element.

18. The firing circuit of claim 17, wherein the firing capacitor includes at least one tantalum capacitor or electrolytic capacitor or ceramic capacitor.

* * * * *